United States Patent [19]

Barford et al.

[11] 4,269,723

[45] May 26, 1981

[54] PROCESS FOR MAKING A LAVATORY CLEANSING BLOCK AND USE

[75] Inventors: Eric D. Barford, Thetford; Robin A. Gray, Attleborough; Michael R. Saul, Hockwold, all of England

[73] Assignee: Jeyes Group Limited, Norfolk, England

[21] Appl. No.: 22,300

[22] Filed: Mar. 20, 1979

[30] Foreign Application Priority Data

Mar. 21, 1978 [GB] United Kingdom ..... 11218/78

[51] Int. Cl.[3] ..... C11D 17/00; C11D 3/50; C11D 3/48

[52] U.S. Cl. ..... 252/106; 252/174; 252/174.11; 252/174.17; 252/174.18; 252/174.23; 252/174.24

[58] Field of Search ..... 252/106, 174, DIG. 16, 252/174.17, 174.18, 174.23, 174.24, 174.11; 239/60; 4/222, 227, 228; 424/76; 264/122

[56] References Cited

U.S. PATENT DOCUMENTS

| | | | |
|---|---|---|---|
| 3,378,495 | 4/1968 | Buck | 252/107 |
| 3,424,842 | 1/1969 | Nurnberg | 264/122 X |
| 3,538,520 | 11/1970 | Leavitt | 4/222 |
| 3,630,925 | 12/1971 | Buck | 252/106 X |
| 3,721,629 | 3/1973 | Goodenough | 252/106 X |
| 4,043,931 | 8/1977 | Jeffrey et al. | 252/106 X |
| 4,155,742 | 5/1979 | Sakurai et al. | 252/106 X |

FOREIGN PATENT DOCUMENTS

| | | | |
|---|---|---|---|
| 1364459 | 8/1974 | United Kingdom | 252/106 |
| 1364460 | 8/1974 | United Kingdom | 252/106 |
| 1465475 | 2/1977 | United Kingdom | 252/106 |

OTHER PUBLICATIONS

Kalman, "Poly(Vinylpyrrolidinone) as Tablet Binding MateriaL," Acta Pharm. Hung. 33(6), 271–4 (1963), CA 60:6706b.

Sakr et al., "Evaluation of Sodium Alginate as a Binder for a Water-Soluble Tablet," Can. J. Pharm. Sci. 1973, 8(1), 6–12, CA 79:9841p.

Delunca et al., "Binding Activity of Hydroxypropyl Cellulose and its Effect on the Physical Characteristics of Granules and Tablets," Farmaco, Ed. Prat. 1977, 32(4), 157–71, CA 86:195164n.

*Primary Examiner*—Harris A. Pitlick

*Attorney, Agent, or Firm*—Stevens, Davis, Miller & Mosher

[57] ABSTRACT

A process for the preparation of a lavatory cleansing tablet for immersion in the cistern of a lavatory comprises forming a free-flowing particulate mixture consisting essentially of:

(a) from 5 to 90% by weight of a surface active component comprising one or more organic surface active agents, especially anionic or nonionic surface active agents;

(b) from 0.5 to 75% by weight of one or more binders selected from clays and, preferably, water-soluble or water-dispersible gel-forming organic polymeric materials, especially cellulose derivatives;

(c) from 0 to 20% of one or more dyestuffs;

(d) from 0 to 35% by weight of a perfume component comprising a solid perfume or a liquid perfume optionally in admixture with a solid absorbent therefor;

(e) a total of from 0 to 75% by weight of;

(i) one or more inert water-soluble fillers;

(ii) one or more water-softening or chelating agents;

(iii) one or more solid water-soluble acids;

(iv) one or more inert water-insoluble inorganic or polymeric organic fillers (in an amount of not more than 50% by weight of the mixture);

(v) one or more tablet lubricants (in an amount of not more than 30% by weight of the mixture).

(f) from 0 to 20% by weight of one or more germicides, fungicides, and/or chlorine release agents; and compressing the mixture to form a tablet.

The invention also provides tablets produced by such a process which tablets suitably have a weight of from 20 to 150 grams, especially from 30 to 70 grams. In another aspect the invention provides a method of cleansing a lavatory which comprises immersing in the cistern of the lavatory a tablet produced in accordance with the invention.

25 Claims, No Drawings

PROCESS FOR MAKING A LAVATORY CLEANSING BLOCK AND USE

This invention is concerned with improvements in and relating to blocks for cleansing lavatory bowls or urinals.

More particularly, this invention is concerned with cleansing blocks which are immersed in the flush-water cistern of a lavatory bowl or urinal and are slowly dissolved in the water therein, thereby to release active ingredients contained in the blocks to the water, which active ingredients serve to assist in cleansing the lavatory bowl or urinal when water is flushed from the cistern into the lavatory bowl or urinal. Such blocks generally comprise two types, the "containerised" type and the "naked" type. In the case of the former, the block is contained in a suitable container generally so arranged as to allow for a more or less metered dose of the block to be dissolved into the flushing water in the cistern each time the lavatory bowl or urinal is flushed. The "naked" block does not involve the use of such a container, the solubility characteristics of the block being such that the block only slowly dissolves to release its active ingredients to the water in the cistern.

In both cases the composition of which the block is formed generally comprises a water-soluble surface active agent to impart cleansing or detergent properties to the flush water and in the case of the naked block the composition also contains one or more hydrophobic materials or relatively water-insoluble materials to slow down the rate of dissolution of the block. The formulation of a naked block is thus so arranged that the block, which is wholly immersed in the water of the cistern, slowly dissolves in the water of the cistern over a fairly extended period of time.

The naked block compositions are commonly prepared by forming a melt of the components and the molten composition is then moulded in suitable moulds to form the blocks and this often proves to be a time-consuming and generally messy operation.

It has now been found, in accordance with the present invention, that naked type blocks may be prepared from a composition comprising certain ingredients by forming a free-flowing mixture of the ingredients in particulate form and subsequently compressing the mixture to tablet form on a tabletting press.

Accordingly, one embodiment of the present invention provides a process for the preparation of a lavatory cleansing tablet which comprises forming a free-flowing particulate mixture consisting essentially of:

(a) from 5 to 90% by weight of a surface active component comprising one or more organic surface active agents;

(b) from 0.5 to 75% by weight of one or more binders selected from clays and water-soluble or water-dispersible gel-forming organic polymeric materials;

(c) from 0 to 20% of one or more dyestuffs;

(d) from 0 to 35% by weight of a perfume component comprising a solid perfume or a liquid perfume optionally in admixture with a solid absorbent therefor;

(e) a total of from 0 to 75% by weight of (i) one or more inert water-soluble fillers;

(ii) one or more water-softening or chelating agents;

(iii) one or more solid water-soluble acids;

(iv) one or more insert water-insoluble inorganic or polymeric organic fillers (in an amount of not more than 50% by weight of the mixture);

(v) one or more tablet lubricants (in an amount of not more than 30% by weight of the mixture).

(f) from 0 to 20% by weight of one or more germicides, fungicides, and/or chlorine release agents; and compressing the mixture to form a tablet.

The invention also provides lavatory cleansing tablets when produced by the above process.

The two essential ingredients of the particulate mixture used in preparing tablets in accordance with the invention (which will simply hereinafter be referred to as "the particulate mixture") and, hence, of the tablets prepared in accordance with the invention are (a) an organic surface active agent component and (b) a binder component and in its simplest form the particulate mixture may comprise only these two ingredients. However, the tablets produced in accordance with the invention may, and frequently desirably do, contain other ingredients as indicated above.

One principal and essential ingredient of the particulate mixture is the binder. This may be a clay, such as bentonite or Laponite, or, preferably, a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents.

The binder is also believed to serve another purpose in controlling the rate of dissolution of the tablet. Thus, whilst we do not wish to be limited by theoretical considerations, it is believed that the mode of dissolution of the tablet of the invention is somewhat as follows. The tablet is introduced into the cistern containing water and sinks to the bottom (as discussed below the tablet should have an apparent specific gravity greater than that of water to ensure that it does so). The water in the cistern dissolves or disperses a part of the exposed surface of the tablet and, in consequence of the presence of the binder a layer of thickened gelled solution is formed around the tablet. (Where the binder is a clay it is believed that a thickened solution of surface active agent containing disposal binder is formed whereas where the binder is a gel-forming polymer a gel containing dissolved surface active agent is formed).

Since the water in the cistern is comparatively still this layer tends to remain in contact with the tablet (although of course some diffusion of the gel layer to the body of water in the cistern will occur, but only slowly), thereby tending to isolate the tablet from the body of water in the cistern thereby protecting or retarding further dissolution of the tablet. When the cistern is flushed the movement of the outgoing water removes at least a part of the thickened or gelled layer and due to the agitation and turbulence of the outgoing water this layer is dispersed and dissolved in the flushed water. The cistern is then refilled with water until relatively still water conditions obtain in the cistern and, as described above, a thickened or gelled layer again forms around the tablet.

A wide variety of water-soluble polymers are suitable for use in accordance with the invention. Such polymers may be wholly synthetic or may be semi-synthetic polymers derived from natural materials. Thus, for example, on class of polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of polymers which may be used are naturally derived polymeric materials such as alginates and caragheenates; alternatively the semi-synthetic analogues thereof produced by fermentation processes may also be used. Similarly, water-soluble starches and gelatin may be used as organic polymers in accordance with the invention.

The cellulose based binders are a preferred class of binder for use in the invention and may possess the property of inverse solubility that is their solubility decreases with increasing temperature, thereby rendering the tablets of the invention suitable for use in locations having a relatively high ambient temperature.

Wholly synthetic polymers which may be used in accordance with the invention include polyvinyl alcohols; water-soluble partially hydrolysed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; and carboxypolymethylenes.

In the case of the organic polymeric binders it may be noted that, in general, the higher the molecular weight of the polymer the greater the in-use life of the tablet, other things being equal. The total binder content of the particulate mixture is from 0.5 to 75% by weight, preferably from 1 to 70% by weight, more preferably from 5 to 60% by weight.

The second essential ingredient used in the particulate mixture is a surface active agent. Virtually any surface active agent, may be used in the process of the invention, provided that it may be obtained in a form suitable for tabletting, and thus the surface active agent may be anionic, nonionic, cationic or amphoteric in nature. Suitable anionic surface active agents include, for example, alkali metals salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides. Suitable nonionic surface active agents include, for example, alkylene oxide condensates of fatty acids, fatty alcohols or alkyl substituted phenols; ethylene oxide/propylene oxide block copolymers; amine ethoxylates; fatty acid alkanolamides; sucrose surfactants and fatty acid alkanolamide ethoxylates. Suitable cationic surface active agents include quaternary ammonium bromides and chlorides containing a long chain alkyl group such as, for example, Cetrimide or benzalkonium chloride. Suitable amphoteric surface active agents include so-called "betaine" type and imidazoline type surface active agents.

It may be noted that cationic surface active agents also often possess germicidal properties and thereby impart not only detergent activity but germicidal activity to the flushing water.

The surface active agent component of the tablet may comprise one surface active agent or may comprise a mixture of compatible surface active agents.

The surface active agent component will be present in the particulate mixture in an amount of 5 to 90% by weight, preferably from 5 to 80% by weight, more preferably from 5 to 60% by weight. The most preferred content for surface active agent is from 10 to 40% by weight.

The tablets will generally also contain a dyestuff in order to impart a pleasant coloration to the water and also to indicate to the user when the tablet has become exhausted (i.e., on exhaustion of the tablet the water becomes colourless). Accordingly, the particulate mixture preferably contains a powdered solid dyestuff, suitably in an amount of up to 20% by weight, preferably in an amount of from 1 to 15% by weight, more preferably from 1 to 10% by weight. Suitable dyestuffs include, for example, acid blue 1 and acid blue 9 type dyes.

The tablets may also contain perfumes to impart an acceptable odour to the flushing water. The perfume may be a solid perfume which term is intended to include microencapsulated perfumes (i.e. liquid perfumes contained in a water-soluble microcapsule). The use of liquid perfumes gives rise to problems in that the particulate mixture should be free-flowing so that although small amounts, e.g. up to 10% by weight, preferably not more than 5% by weight, of liquid may be tolerated in the particulate mixture it is preferred to use liquid perfumes in admixture with solid absorbents therefor such as fumed silica diatomaceousearth. The total amount of perfume, when solid form is suitably up to 35% by weight, preferably from 2 to 20% by weight of the particulate mixture. If a liquid perfume is employed then it is preferably used in amounts of not more than 10% by weight, preferably in an amount of from 1 to 10% by weight, in admixture with from 1 to 25% by weight of solid absorbent. Other solid perfuming material, such a paradichlorbenzene or diphenyl oxide may be employed, suitably in amounts of not more than 10% by weight, preferably from 1 to 10% by weight. In this connection it may be noted that the term "perfume" is intended to refer to any material giving an acceptable odour and thus materials giving a "disinfectant" odour and thus materials giving a "disinfectant" odour such as pine oils, terpinolenes or paradichlorobenzene may be employed.

The tablets in accordance with the invention may also contain germicides, fungicides and/or chlorine release agents, especially when the surface active agent employed is not a cationic germicidal surface active agent. Suitable germicides include, for example, formaldehyde release agents, chlorinated phenols and suitable chlorine release agents include sodium dichloroisocyanate. These components may be present in the particulate mixture in amounts of up to 20% by weight, preferably from 1 to 15% by weight, although it is to be understood that where the surface active agent is germicidal, these weight limitations do not apply.

The tablets may also contain inert water-soluble fillers, for example organic fillers such as urea or water-soluble inorganic fillers such as sodium carbonate, sodium bicarbonate, sodium chloride, copper sulphate, sodium sulphate, borax, zinc sulphate and the like. It may be noted that where copper salts, such as copper sulphate, are employed as fillers they may also serve to impart fungicidal or fungistatic properties to the flush water.

Other ingredients which may be present in the tablets of the invention include water-softening or chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof.

The mixture may also contain particulate solid water-insoluble fillers such as talc or particulate organic polymeric materials but these should not be presen in an amount of more than 50% by weight of the mixture, preferably not more than 30% by weight of the mixture.

The mixture may also contain solid water-soluble acids or acid-release agents such as sulphamic acid, citric acid and sodium hydrogen sulphate.

The tablets may also contain other ingredients serving to assist in the manufacture thereof, for example tablet lubricants to prevent the tablets binding to the die or punch, such as metallic stearates, stearic acid, paraffin oils or waxes or sodium borate, in amounts not exceeding 30% by weight of the mixture. The mixture should preferably contain not more than 30% in total of such ingredients and solid particulate inert water-insoluble fillers.

Preferably the mixture will contain a total of from 0 to 60%, more preferably 20 to 50% by weight of inert water-soluble fillers, water-softening or chelating agents, water-soluble acids, water-insoluble particulate inert fillers and tablet lubricants.

The process of the invention makes it possible to produce lavatory cleansing tablets from ingredients which are readily water-soluble or water-dispersible, i.e. which readily form solutions or dispersions on contact with water, in contradistinction to the hydrophobic or difficulty water-soluble materials employed in prior art blocks.

In accordance with the invention the component ingredients of the tablet in particulate form are formed into a particulate mixture and then tabletted to tablets of the desired size, e.g. tablets having a weight of from 20 to 150 grams, preferably from 30 to 70 grams. The tablets should have an apparent density greater than that of water so that they will sink in the cistern and rest upon the bottom thereof and it has been found that the tablets generally have an apparent density in excess of 2 gms/cc, i.e. well above that of water.

It is generally preferred that the mixture to be tabletted consists only of dry particulate materials, i.e. does not contain any liquid but small amounts of liquid, e.g. up to 15% by weight of the total mixture, can be tolerated and thus the term powder mixture is intended to cover mixtures containing such small amounts of liquid.

The solid ingredients in the powder mixture are in particulate form and thus may be in the form of powders, granules (for example having a particular size of up to 1 mm) or flakes.

The pressure under which the powder mixture is compressed to form the tablets is of importance in that if the pressure is too low, the tablet has an insufficiently high strength and tends to dissolve too rapidly whereas if the pressure is too high the tablet tends to dissolve too slowly. The actual pressure employed for making a tablet out of any particular composition will depend, to some extent, upon the nature of the ingredients and their relative proportions in the mixture. For example it has been found that for tablets incorporating sodium carboxymethyl cellulose as binder, pressures of the order of 0.5 to 100, more preferably 2 to 25 tons sq/inch are suitable. In any event it will be a matter of simple routine trial to establish the preferred measure for tabletting any particular particulate mixture.

The tablets produced in accordance with the invention may subsequently be provided with a coating of a water-soluble film, such as polyvinyl acetate, to make handling thereof more convenient although it has been noted that tablets produced in accordance with the invention are much more clean to handle than are blocks produced by the prior art method of melting the ingredients.

As noted above the tablets in accordance with the invention are generally more simple and convenient to prepare than are the blocks of the prior art prepared by melting the ingredients and mixing the resultant mixture. Further the tablets of the invention are generally markedly stronger and have a greater tolerance to or stability at elevated temperatures and relative humidities than the prior art blocks.

As noted above the tablets in accordance with the invention are generally more simple and convenient to prepare than are the blocks of the prior art prepared by melting the ingredients and mixing the resultant mixture. Further the tablets of the invention are generally markedly stronger and have a greater tolerance to or stability at elevated temperatures and relative humidities than the prior art blocks.

The invention also provides a method of cleansing a lavatory or urinal which comprises immersing a tablet in accordance with the invention in the cistern thereof.

In order that the invention may be well understood the following Examples are given by way of illustration only.

EXAMPLES

Lavatory cleansing tablets were prepared by forming a mixture of particulate ingredients listed below in the amounts listed below and tabletting the mixture to form tablets having a weight of about 50 grams with a 5 cm diameter die and punch under a pressure of about 10 tons/sq. inch.

| | Binder | | Surfactant | | Dye | | Perfume | | Diluent | | Germicide | | Others | |
|---|---|---|---|---|---|---|---|---|---|---|---|---|---|---|
| Example | Type | % w/w | Type | % w/w | Type | % w/w | Type | % w/w | Type | % w/w | Type | % w/w | Type | % w/w |
| 1 | CMC-L | 60 | NDBS | 20 | AB9 | 5 | Encap | 5 | NaCl | 5 | Cet. | 5 | — | — |
| 2 | CMC-M | 40 | EAE | 20 | AB1 | 5 | Encap | 5 | $NaHCO_3$ | 25 | Myr | 5 | — | — |
| 3 | HPC-L | 50 | EO/PO | 20 | AB9 | 5 | Encap | 5 | $NaBO_4$ | 15 | Cet | 5 | — | — |
| 4 | HPC-J | 30 | SLS | 20 | AB9 | 5 | Encap | 5 | NHMP | 35 | Pf. | 5 | — | — |
| 5 | CMC-L | 60 | NDBS | 20 | AB9 | 5 | Encap | 5 | Talc | 5 | Cet. | 5 | — | — |
| 6 | PVA | 70 | EAP | 15 | AB9 | 5 | PDCB | 5 | — | — | Cet | 5 | — | — |
| 7 | Cg | 75 | EAT | 10 | AB9 | 5 | Encap | 5 | — | — | Pf | 5 | — | — |

-continued

| Example | Binder Type | Binder % w/w | Surfactant Type | Surfactant % w/w | Dye Type | Dye % w/w | Perfume Type | Perfume % w/w | Diluent Type | Diluent % w/w | Germicide Type | Germicide % w/w | Others Type | Others % w/w |
|---|---|---|---|---|---|---|---|---|---|---|---|---|---|---|
| 8 | MVMA | 20 | NDBS | 20 | AB9 | 5 | Encap | 5 | $ZnSO_4$ | 45 | Myr | 5 | — | — |
| 9 | HPMC | 10 | NDBS | 30 | AB9 | 4 | Tp | 2 | NaCl | 52 | Cet | 1 | Sip | 1 |
| 10 | " | 5 | NDBS | 30 | AB9 | 4 | Tp | 3 | NaCl | 54.5 | Cet | 1.5 | Sip | 2 |
| 11 | " | 5 | NDBS | 40 | AB9 | 4 | Tp | 3 | NaCl | 43.5 | Cet | 1.5 | Sip | 1.5 |
| | | | LDE | 1.5 | | | | | | | | | | |
| 12 | " | 7 | NDBS | 25 | AB9 | 4 | Tp | 2 | NaCl | 55 | Cet | 1 | Sip | 1 |
| | | | LDE | 5 | | | | | | | | | | |
| 13 | " | 5 | NDBS | 25 | AB9 | 4 | Tp | 2 | NaCl | 57 | Cet | 1 | Sip | 1 |
| | | | LDE | 5 | | | | | | | | | | |
| 14 | " | 5 | NDBS | 50 | AB9 | 4 | Tp | 2 | NaCl | 32.5 | Cet | 1.5 | Sip | 1.5 |
| | | | LDE | 3.5 | | | | | | | | | | |
| 15 | " | 10 | EAA | 20 | AB9 | 4.5 | Tp | 7.5 | NaCl | 10 | Cet | 1.5 | Sip | 7.5 |
| | | | | | | | | | STP | 39 | | | | |
| 16 | " | 1 | NDBS | 30 | AB9 | 4.5 | Tp | 5 | NaCl | 48 | Cet | 1.5 | Sip | 5 |
| | | | | | | | | | | | | | MgS | 5 |
| 17 | " | 10 | NDBS | 30 | AB9 | 4 | Tp | 5 | NaCl | 46.5 | Cet | 1.5 | Sip | 3 |
| 18 | LCP | 5 | NDBS | 35 | AB9 | 4 | — | — | NaCl | 55 | Cet | 1 | — | — |
| 19 | ATG | 5 | NDBS | 35 | AB9 | 4 | — | — | NaCl | 55 | Cet | 1 | — | — |

Notes to Table
CMC-L = sodium carboxy methyl cellulose (Courlose A610-low viscosity)
CMC-M = sodium carboxy methyl cellulose (Courlose A650-medium viscosity)
HPC-L = hydroxypropyl cellulose (Klucel-L)
HPC-J = hydroxypropyl cellulose (Klucel-J)
PVA = polyvinyl alcohol (Gohsenol KH20)
Cg = Carragheenin (Genugel RLV)
MVMA = methylvinylether/maleic anhydride resin (Gantrez AN 139)
HPMC = hydroxypropylmethyl cellulose (Celacol HPM 5000)
LCP = Laponite CP (clay)
ATS = Attagel 50 (clay)
NDBS = sodium dodecyl benzene sulphonate (Nansa HS 8 0S)
EAE = ethoxylated fatty alcohol (Empilan KM 50)
EO/PO = Ethylene oxide/propylene oxide block copolymer (Monolan 8000E)
SLS = sodium lauryl sulphate (Tensopol USP)
EAP = ethoxylated alkyl phenol (Ethylan N50)
EAT = ethoxylated fatty alcohol (Texophor A60)
LDE = lauric diethanolamide (Empilan LDE)
EAA = ethoxylated fatty alcohol (Cetalox AT)
AB9 = Blue dye (Acid blue 9 type)
AB1 = Blue dye (Acid blue 1 type)
Encap = microencapsulated perfume
PDCB = paradichlorobenzene
Tp = terpinolene
NaCl = sodium chloride (pure vacuum dried)
STP = sodium tripolyphosphate
$NaHCO_3$ = sodium bicarbonate
$NaBO_4$ = sodium borate (borax)
NHMP = sodium hexametaphosphate
Talc = Talc B.P.C.
$ZnSO_4$ = Zinc sulphate
Cet = Alkyltrimethyl ammonium bromide (Cetrimide B.P.)
Myr = Myristyl dimethylbenzyl ammonium chloride (Querton 14 BC)
Pf = Paraformaldehyde
Sip = Fumed silica (perfume carrier) (Sipernat 22 S)
Sil = Fumed silica (perfume carrier) (Silica FK 320DS)
MgS = Magnesium stearate (tablet lubricant)

We claim:

1. A process for the preparation of a lavatory cleansing tablet adapted for immersible use in the cistern of a lavatory which comprises forming a free-flowing particulate mixture consisting essentially of:
   (a) from 5 to 90% by weight of a surface active component comprising one or more organic surface active agents;
   (b) from 0.5 to 75% by weight of one or more binders which act as dissolution retarding agents selected from clays and water-soluble or water-dispersible gel-forming organic polymeric materials;
   (c) from 0 to 20% of one or more dyestuffs;
   (d) from 0 to 35% by weight of a perfume component comprising a solid perfume or a liquid perfume optionally in admixture with a solid absorbent therefor;
   (e) a total of from 0 to 75% by weight of:
      (i) one or more inert water-soluble fillers;
      (ii) one or more water-softening or chelating agents;
      (iii) one or more solid water-soluble acids;
      (iv) one or more inert water-insoluble inorganic or polymeric organic fillers (in an amount of not more than 50% by weight of the mixture);
      (v) one or more tablet lubricants (in an amount of not more than 30% by weight of the mixture);
   (f) from 0 to 20% by weight of one or more germicides, fungicides, and/or chlorine release agents;
   and compressing the mixture to form a tablet.

2. A process as claimed in claim 1 in which said particulate mixture contains a total of from 10 to 90% by weight of organic surface active agents and binders.

3. A process as claimed in claim 2 in which said particulate mixture contains a total of from 20 to 90% by weight of binder(s) and organic surface active agents.

4. A process as claimed in claim 1 in which said mixture contains from 5 to 80% by weight of surface active agent(s).

5. A process as claimed in claim 4 in which said mixture contains from 5 to 60% by weight of surface active agent(s).

6. A process as claimed in claim 5 in which said mixture contains from 10 to 40% by weight of surface active agent(s).

7. A process as claimed in claim 1 in which the mixture contains from 1 to 70% by weight of binder(s).

8. A process as claimed in claim 7 in which the mixture contains from 5 to 60% by weight of binder(s).

9. A process as claimed in claim 1 in which the perfume is a microencapsulated perfume and is present in the particulate mixture in an amount of from 2 to 20% by weight.

10. A process as claimed in claim 1 in which the perfume is a liquid perfume and is present in the mixture in an amount of from 1 to 10% by weight, in admixture with from 1 to 15% by weight of a solid absorbent therefor.

11. A process as claimed in claim 1 in which the mixture contains from 1 to 15% by weight of dyestuff.

12. A process as claimed in claim 11 in which the dyestuff is present in the mixture in an amount of from 1 to 10% by weight.

13. A process as claimed in claim 1 in which the mixture contains from 1 to 15% by weight of germicide.

14. A process as claimed in claim 1 in which the mixture contains from 0 to 50% by weight of component(e).

15. A process as claimed in claim 14 in which the mixture contains from 20 to 50% by weight of component(e).

16. A process as claimed in claim 1 in which the mixture is compressed to form a tablet having a weight of from 20 to 150 grams.

17. A process as claimed in claim 16 in which the mixture is compressed to form a tablet having a weight of from 30 to 70 grams.

18. A process as claimed in claim 1 in which the binder is a cellulose ether.

19. A process as claimed in claim 18 in which the cellulose ether is methyl cellulose, ethyl cellulose, sodium carboxymethyl cellulose, hydroxypropyl cellulose, hydroxypropyl methyl cellulose, ethyl hydroxyethyl cellulose, carboxymethyl hydroxyethyl cellulose or hydroxyethyl cellulose.

20. A process as claimed in claim 1 in which the binder is an alginate or caragheenate.

21. A process as claimed in claim 1 in which the binder is a wholly synthetic polymer.

22. A process as claimed in claim 21 in which the binder is a polyvinyl alcohol, water-soluble partially hydrolysed polyvinyl acetate, polyacrylonitrile, polyvinyl pyrolidones, water-soluble polymer of an ethylenically unsaturated carboxylic acid, or salt thereof, base-hydrolysed starch-polyacrylonitrile copolymer, ethylene oxide polymer or a carboxypolymethylene.

23. A process as claimed in claim 1 in which the organic surface active is an anionic surface active agent selected from alkali metal salts of alkyl substituted benzene sulphonic acids, alkali metal salts of long chain fatty sulphates, alkali metal ether sulphates derived from alcohols and alkyl phenols, alkali metal sulphosuccinates, alkali metal sarcosinates and alkali metal taurides.

24. A process as claimed in claim 1 in which the organic surface active agent is a nonionic surface active agent selected from alkylene oxide condensates of fatty acids, fatty alcohols or alkyl substituted phenols; ethylene oxide/propylene oxide block copolymers; fatty acid mono- and di- alkanolamides and ethoxylates thereof, and sucrose surfactants.

25. A method of cleansing a lavatory or urinal which comprises immersing in the cistern thereof a tablet obtained by a process as claimed in claim 1.

* * * * *